US010350685B2

(12) United States Patent
Hur et al.

(10) Patent No.: US 10,350,685 B2
(45) Date of Patent: Jul. 16, 2019

(54) METHOD FOR PREPARING METAL NANOPARTICLES

(71) Applicant: SOGANG UNIVERSITY RESEARCH FOUNDATION, Seoul (KR)

(72) Inventors: Nam Hwi Hur, Seoul (KR); Byeongno Lee, Gyeonggi-do (KR); Kyu Hyung Lee, Seoul (KR)

(73) Assignee: SOGANG UNIVERSITY RESEARCH FOUNDATION (KR)

( * ) Notice: Subject to any disclaimer, the term of this patent is extended or adjusted under 35 U.S.C. 154(b) by 119 days.

(21) Appl. No.: 15/263,740

(22) Filed: Sep. 13, 2016

(65) Prior Publication Data

US 2016/0375496 A1 Dec. 29, 2016

Related U.S. Application Data

(63) Continuation of application No. PCT/KR2015/001098, filed on Feb. 3, 2015.

(30) Foreign Application Priority Data

Feb. 3, 2014 (KR) ..... 10-2014-0012084

(51) Int. Cl.
*B22F 9/20* (2006.01)
*B22F 9/24* (2006.01)
*B22F 1/00* (2006.01)

(52) U.S. Cl.
CPC ..... *B22F 9/24* (2013.01); *B22F 1/0018* (2013.01); *B22F 9/20* (2013.01)

(58) Field of Classification Search
None
See application file for complete search history.

(56) References Cited

U.S. PATENT DOCUMENTS

| | | | | |
|---|---|---|---|---|
| 5,498,446 | A | 3/1996 | Axelbaum et al. | |
| 6,203,768 | B1 | 3/2001 | McCormick et al. | |
| 2004/0253536 | A1* | 12/2004 | Park | G03F 7/0047 430/270.1 |
| 2009/0148600 | A1* | 6/2009 | Li | B22F 1/0022 427/256 |
| 2010/0034693 | A1* | 2/2010 | Li | B22F 1/0018 420/501 |
| 2011/0305685 | A1* | 12/2011 | Tseng | B82B 3/00 424/130.1 |
| 2013/0052368 | A1* | 2/2013 | Rushworth | C23C 16/18 427/569 |
| 2015/0094490 | A1* | 4/2015 | Hur | C07C 271/02 562/555 |

FOREIGN PATENT DOCUMENTS

| | | | |
|---|---|---|---|
| KR | 100790458 | B1 | 1/2008 |
| KR | 10-2010-0019372 | A | 2/2010 |
| KR | 10-2011-0020966 | A | 3/2011 |
| KR | 10-2013-0097981 | A | 9/2013 |
| KR | 10-2013-0103979 | A | 9/2013 |

OTHER PUBLICATIONS

Lee et al., "Isolation and structural characterization of the elusive 1 : 1 adduct of hydrazine and carbon dioxide", Chem. Commun., 2011, vol. 47, pp. 11219-11221.
International Search Report of PCT/KR2015/001098 dated May 11, 2015.

* cited by examiner

*Primary Examiner* — George Wyszomierski
(74) *Attorney, Agent, or Firm* — Riverside Law LLP

(57) ABSTRACT

The present disclosure relates to a method for preparing metal nanoparticles, and particularly, to a method for preparing metal nanoparticles, the method including reacting a hydrazine-carbon dioxide binded compound with a metal oxide or a metal ion compound.

5 Claims, 5 Drawing Sheets

METHOD FOR PREPARING METAL NANOPARTICLES

CROSS-REFERENCE TO RELATED APPLICATIONS

This application claims priority from PCT application no. PCT/KR2015/001098, filed Feb. 3, 2015 and Korean patent application no. 10-2014-001284, filed Feb. 3, 2014, each of which is hereby incorporated by reference in their entirety.

TECHNICAL FIELD

The invention relates to a method for preparing metal nanoparticles, and particularly, to a method for preparing metal nanoparticles, the method including reacting a hydrazine-carbon dioxide binded compound with a metal oxide or metal ion compound.

BACKGROUND

Nanomaterial technology can show novel functions and characteristics which cannot be obtained from conventional materials and thus may be referred to as the most advanced fusion material technology which can be applied to various fields and industries.

For example, platinum nanocolloid is expected to be highly useful in cosmetics and food supplement fields. This is because the conventional materials regarded as having antioxidant properties can remove only a specific reactive oxygen species from seven kinds of reactive oxygen species in the body and do not act anymore if once they remove the reactive oxygen, whereas platinum nanocolloid can remove all reactive oxygen species and semipermanently act while remaining in the form of colloid in the body. Therefore, if platinum nanoparticles prepared without impurities using a colloid protective agent harmless to the human body are colloidized, the application thereof is not limited to catalyst, photoelectron, sensor, conductive device, and bio fields but can be expanded to medical and food supplement fields, and thus, the marketability thereof is expected to be highly increased.

In this nanotechnology, nanomaterials have been manufactured and applied as structures in various forms such as powder, tube, whisker, and thin film. Among these forms, powder and thin film forms are the most common. Techniques for preparing nanomaterials in the form of thin film have been practically accumulated for a long time, whereas techniques for preparing nanomaterials in the form of powder have been researched and developed but have not often been commercialized due to difficulties in reproducible production and storage.

In the case of a metal powder nanomaterial, as a size of powder is decreased, surface energy is increased due to an increase in specific surface area, and thus, the powder becomes unstable. Further, if metal has a critical size or less, the reactivity is increased, and thus, the metal can react with oxygen in air and causes spontaneous combustion. Therefore, an attempt to prepare highly active nanosized metal powder and stably use it is more desperately needed.

Further, along with a gradual spread of the fact that the industrial importance of metal nanoparticles is very high, the demand for a technique of mass-producing metal nanoparticles through an eco-friendly and economically competitive process has been greatly increased. Various methods for preparing nanoparticles have been developed, and can be roughly divided into vapor phase synthesis of synthesizing nanoparticles in a gaseous state and liquid phase synthesis including dissolution in a solution and growth of crystals. In general, the vapor phase synthesis has received attention as a method for mass-producing high-purity particles, but according to the vapor phase synthesis, primary particles produced during a reaction process are agglomerated to form clustered secondary particles, resulting in the production of strongly agglomerated particles, and thus, it is difficult to prepare nanoparticles with a uniform small size of 100 nm or less.

In this regard, methods of preparing nanoparticles through an aerosol method and evaporation/condensation in a gaseous phase, and the like have been widely developed as methods for synthesizing particles having a diameter of 100 nm or less. However, the vapor phase synthesis has not been widely used industrially because 1) it is difficult to mass-produce nanoparticles, 2) it is difficult to control a particle size and thus a separate process for particle separation is needed, 3) a process is performed at a high temperature in many cases, and 4) costs for preparing particles are generally high. As a method for resolving agglomeration of nanoparticles, a method for producing non-agglomerated nanoparticles by flame synthesis is disclosed in U.S. Pat. No. 5,498,446. According this method, when metal or ceramic particles are synthesized by heating a halogen-containing precursor in a reaction area of flame synthesis, a vaporized metal such as sodium (Na) is introduced, so that the metal or ceramic particles are coated with a by-product, i.e., sodium chloride (NaCl), and NaCl is dissolved using water or a solvent to separate particles of 100 nm or less from agglomerated nanoparticles. However, according to this method, a solvent is needed, and thus, there is a problem that a preparation process is complicated.

Meanwhile, in the case of the liquid phase synthesis, a preparation process is simple and economical, but the liquid phase synthesis has limitations in restricting a particle size to the range of nanometers and requires the use of a solvent and a reducing agent and thus may cause environmental problems. After the preparation of particles, additional processes for separating nanoparticles from a solution and purifying the nanoparticles are needed, and thus, the liquid phase synthesis has difficulty in mass-production. Further, in the case of using an organic solvent and a reducing agent together, volatile organic chemicals (VOCs) may be generated due to the use of the solvent and toxic wastewater has been inevitably generated. Furthermore, in most cases, reactants are used in a low weight ratio of from about 5 wt % to about 20 wt %, and thus, it is necessary to use very large reactor and auxiliary equipment relative to the amount of a product. Moreover, in order to obtain the product therefrom, an apparatus for separation and purification is needed, and thus, the preparation process may become complicated and preparation costs may be increased.

Meanwhile, hydrazine hydrate has been used as a reducing agent when metal nanoparticles are prepared from a metal compound dissolved in a solution. In the case of a solution process using a reducing agent such as hydrazine, there are drawbacks such that the productivity is not high due to the need of using a solvent and that an excessive amount of hydrazine needs to be used. Further, an excessive amount of an unused hydrazine solution may be harmful to the human body, and an additional process, such as a waste water treatment, for treating the unused hydrazine solution is needed.

Hydrazine ($N_2H_4$) has chemical properties similar to those of an ammonia ($NH_3$) gas, but it is a clear liquid at room temperature and has melting and boiling points and density similar to those of water. As such, liquid hydrazines may cause contamination due to fire or rapid reaction with an ambient metal or material in case of their leakage, and most of liquid hydrazines contain a great amount of moisture and thus cannot be used in case of need of moistureless condition or have limitations in application due to side reactions caused by water.

As a method for reducing the above-described problems of liquid hydrazine, a method of preparing solid hydrazine salt through a reaction between liquid hydrazine and sulfuric acid or hydrochloric acid and thus using the solid hydrazine salt in substitution for liquid hydrazine has been suggested. Although various kinds of hydrazine salts have been developed, the application thereof has been very limited due to the low reactivity and the need for removing anions remaining after the reaction.

Meanwhile, U.S. Pat. No. 6,203,768 suggests a new method of producing nanoparticles through a mechanochemical method. According to this method, if a metal halide compound such as ferric chloride ($FeCl_3$) and a metal such as sodium (Na) are put into a ball mill and reacted at a high temperature to form iron (Fe) nanoparticles surrounded by sodium chloride (NaCl), and then the sodium chloride (NaCl) is removed by dissolution or sublimation to obtain separated nanoparticles. However, according to this method, a process for removing a solvent is needed and it is difficult to obtain high-purity particles.

Although various methods such as a method using ultrasonic waves, a method using microemulsion, a cavitation processing, and high-energy ball milling have been reported as alternatives of the above-described two methods, these alternatives have not been generally used due to limitations in mass-producing metal nanoparticles and problems with preparation costs.

DISCLOSURE OF THE INVENTION

Problems to be Solved by the Invention

Accordingly, the present disclosure provides a method for preparing metal nanoparticles including reacting a hydrazine-carbon dioxide binded compound with a metal oxide or metal ion compound, and metal nanoparticles prepared by the above-described preparation method.

However, problems to be solved by the present disclosure are not limited to the above-described problems. Although not described herein, other problems to be solved by the present disclosure can be clearly understood by those skilled in the art from the following descriptions.

Means for Solving the Problems

In accordance with a first aspect of the present disclosure, there is provided a method for preparing metal nanoparticles, the method including reacting a hydrazine-carbon dioxide binded compound represented by the following Chemical Formula I or I' with a metal oxide represented by the following Chemical Formula II or a metal ion compound represented by the following Chemical Formula III or IV to obtain metal nanoparticles:

[Chemical Formula I]

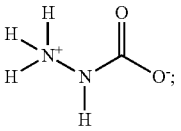

-continued

[Chemical Formula I']

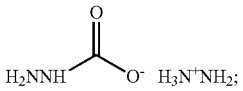

[Chemical Formula II]

$M_aO_b$;

[Chemical Formula III]

$M_aX_b$;

[Chemical Formula IV]

$M_a(OR^1)_b$;

In the above Chemical Formulas, $R^1$ includes a member selected from the group consisting of hydrogen; a member selected from the group consisting of a substituted or unsubstituted $C_{1-30}$ aliphatic hydrocarbon group, a substituted or unsubstituted $C_{3-30}$ aliphatic cyclic group, a substituted or unsubstituted $C_{3-30}$ heteroaliphatic cyclic group, a substituted or unsubstituted $C_{5-30}$ aromatic cyclic group, and a substituted or unsubstituted $C_{5-30}$ heteroaromatic cyclic group; a $C_{1-30}$ aliphatic hydrocarbon group including one or more selected from the group consisting of Si, O, S, Se, N, P, As, F, Cl, Br, and I; a $C_{3-30}$ aliphatic cyclic group including one or more selected from the group consisting of Si, O, S, Se, N, P, As, F, Cl, Br, and I; a $C_{3-30}$ heteroaliphatic cyclic group including one or more selected from the group consisting of Si, O, S, Se, N, P, As, F, Cl, Br, and I; and a $C_{5-30}$ heteroaromatic cyclic group including one or more selected Si, O, S, Se, N, P, As, F, Cl, Br, and I, M includes a metal element, X includes a halogen element, and a and b are positive integers.

In accordance with a second aspect of the present disclosure, there are provided metal nanoparticles prepared by the preparing method in accordance with the first aspect of the present disclosure.

Effects of the Invention

According to a method for preparing metal nanoparticles in an embodiment of the present disclosure, a very small reactor can be used and particularly, in the case of using a metal oxide as a precursor, a product can be quantitatively obtained with almost no by-products except carbon dioxide, nitrogen and water, and a solid or solvent-free reaction process can be provided, and thus, it is possible to reduce production equipment and production costs. Further, in the case of using a slurry solvent, a solvent is used in the amount of about 70 wt % or less with respect to the total product, and thus, it is possible to provide an efficient process with a high reaction rate as compared with the case of using an excessive amount of solvent (>80 wt %). The method for preparing metal nanoparticles in an embodiment of the present disclosure does not need an installment of additional apparatus, costs for separating a solvent, and costs for treating waste water, and thus has excellent economic feasibility and reduction in preparation costs and it is an eco-friendly method using little or no solvent, as compared with a conventional liquid phase reaction process.

Particularly, according to the method for preparing metal nanoparticles in an embodiment of the present disclosure, a hydrazine-carbon dioxide binded compound reacts with a metal precursor such as a metal oxide, a metal-halide salt, or a metal-acetate salt at a low temperature (200° C. or less) in a solid state, a solvent-free state, or a slurry state, and thus, metal nanoparticles can be produced with a yield of about 100% without an additional heat treatment.

Therefore, the method for preparing metal nanoparticles in an embodiment of the present disclosure can provide the following effects: 1) the productivity is high since a great amount of products can be obtained by a very small reactor with no use of a solvent or with a minimum use of a solvent in a slurry state, 2) energy cost can be significantly reduced since a metal is reduced at a low temperature, 3) there is almost no need to perform an additional separation process to materials other than metal particles after a reaction, 4) a size of metal particles can be adjusted in the range of from about 1 nm to about 200 nm by adjusting the amount of a reducing agent (from about 1 equivalent to about 10 equivalents), 5) the economic feasibility is very high since the yield of nanoparticles is about 100%, and 6) waste water and by-products can be minimized.

MODE FOR CARRYING OUT THE INVENTION

Figure 1:
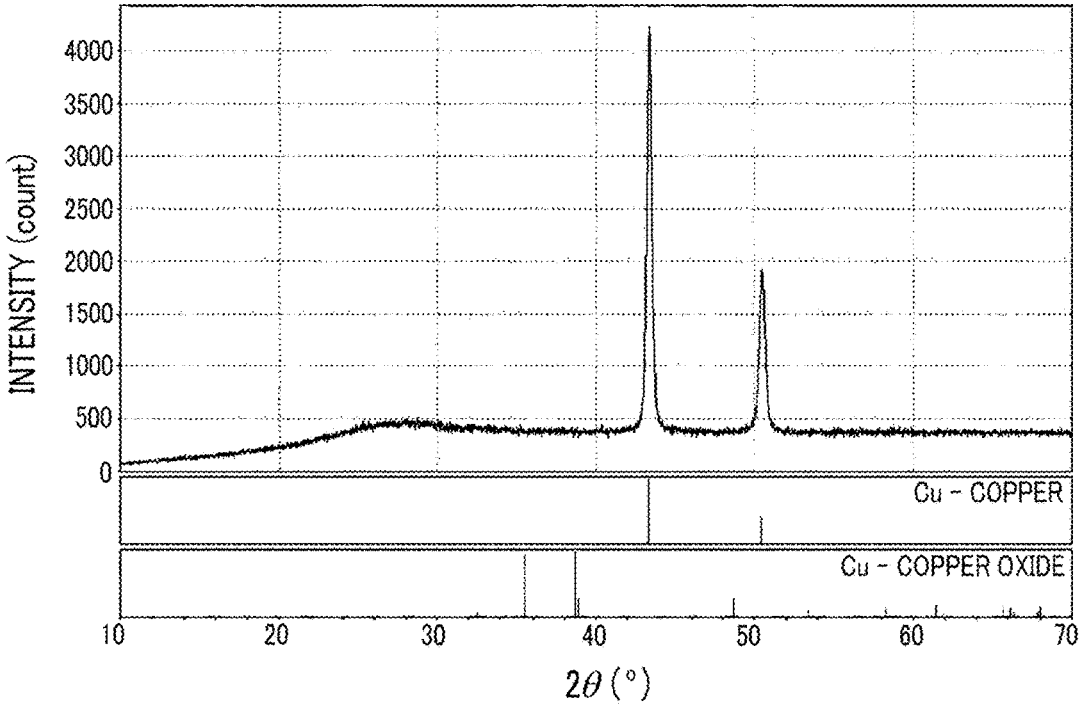
FIG. 1 shows an X-ray diffraction (XRD) analysis pattern of copper nanoparticles prepared in accordance with an example of the present disclosure: the vertical bars at the bottom are theoretical XRD patterns of Cu and CuO, respectively.

Hereinafter, examples of the present disclosure will be described in detail so that the present disclosure may be readily implemented by those skilled in the art. However, it is to be noted that the present disclosure is not limited to the examples but can be embodied in various other ways.

Through the whole document, the term "connected to" or "coupled to" that is used to designate a connection or coupling of one element to another element includes both a case that an element is "directly connected or coupled to" another element and a case that an element is "electronically connected or coupled to" another element via still another element.

Through the whole document, the term "on" that is used to designate a position of one element with respect to another element includes both a case that the one element is adjacent to the another element and a case that any other element exists between these two elements.

Further, through the whole document, the term "comprises or includes" and/or "comprising or including" used in the document means that one or more other components, steps, operation and/or existence or addition of elements are not excluded in addition to the described components, steps, operation and/or elements unless context dictates otherwise.

Through the whole document, the term "about or approximately" or "substantially" are intended to have meanings close to numerical values or ranges specified with an allowable error and intended to prevent accurate or absolute numerical values disclosed for understanding of the present disclosure from being illegally or unfairly used by any unconscionable third party. Through the whole document, the term "step of" does not mean "step for".

Through the whole document, the term "combination of" included in Markush type description means mixture or combination of one or more components, steps, operations and/or elements selected from a group consisting of components, steps, operation and/or elements described in Markush type and thereby means that the disclosure includes one or more components, steps, operations and/or elements selected from the Markush group.

Through the whole document, a phrase in the form "A and/or B" means "A or B, or A and B".

Through the whole document, the term "aliphatic hydrocarbon group" refers to saturated or unsaturated hydrocarbon group having 1 to 30 carbon atoms and may include a $C_{1-30}$ alkyl group, a $C_{2-30}$ alkenyl group, or a $C_{2-30}$ alkynyl group, but may not be limited thereto.

Through the whole document, the term "alkyl group" may individually include a substituted or unsubstituted linear or branched $C_{1-30}$ alkyl group, or $C_{1-10}$ alkyl group, or $C_{1-5}$ alkyl group, and may include, for example, methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, or acosanyl, and all the possible isomers thereof, but may not be limited thereto. For example, if a $C_{1-30}$ alkyl group is substituted, the carbon number of a substituent is not included in the carbon number of the alkyl group.

Through the whole document, the term "alkenyl group" refers to a linear or branched substituted or unsubstituted unsaturated hydrocarbon group having 2 to 30, 2 to 10, or 2 to 5 carbon atoms and may include, for example, ethenyl group, vinyl group, propenyl group, allyl group, isopropenyl group, butenyl group, isobutenyl group, t-butenyl group, n-pentenyl group, or n-hexenyl group, but may not be limited thereto.

Through the whole document, the term "alkynyl group" refers to a linear or branched substituted or unsubstituted unsaturated hydrocarbon group having 2 to 30, 2 to 10, or 2 to 5 carbon atoms and may include, for example, ethynyl group, propynyl group, butynyl group, pentynyl group, hexynyl group, heptynyl group, octynyl group, nonynyl group, or decynyl group, but may not be limited thereto.

Through the whole document, the term "aliphatic cyclic group" refers to an unsaturated or saturated hydrocarbon cyclic group having 3 to 30, 3 to 10, or 3 to 6 carbon atoms and may include, for example, a cycloalkyl group or a cycloalkenyl group, but may not be limited thereto.

Through the whole document, the term "cycloalkyl group" refers to a substituted or unsubstituted hydrocarbon cyclic group having 3 to 30, 3 to 10, or 3 to 6 carbon atoms and may include, for example, cyclopropyl group, cyclobutyl group, cyclopentyl group, cyclohexyl group, cycloheptyl group, cylcooctyl group, cyclononyl group, or cyclodecyl group.

Through the whole document, the term "halogen" or "halo" includes an element from Group VIIa, for example, chlorine (Cl), bromine (Br), fluorine (F), or iodine (I).

Through the whole document, the term "amine group" or "amino group" includes —$NH_2$ or a nitrogen atom covalently bonded to one or more hydrocarbon groups.

If the above-mentioned functional groups are substituted, the functional groups may be substituted by various substituents at various locations and may be substituted by, for example, a halogen group, a hydroxyl group, a nitro group, a cyano group, a $C_1$-$C_4$ substituted or unsubstituted and linear or branched alkyl group, or a $C_1$-$C_4$ linear or branched alkoxy group, but may not be limited thereto.

Through the whole document, the term "aromatic cyclic group" includes an aryl group, a heteroaryl group, an aryl alkyl group, or a fused aryl group having 6 to 30, 6 to 20, or 6 to 12 carbon atoms.

Through the whole document, the term "aryl group" refers to wholly or partially unsaturated substituted or unsubstituted monocyclic or polycyclic carbon cyclic group. For example, a $C_{6-30}$ aryl group refers to an aryl group having 6 to 30 carbon atoms, and if the $C_{6-30}$ aryl group is substituted, the carbon number of a substituent is not included in the above-described carbon number. For example, the aryl group may include a monoaryl group and a biaryl group. The monoaryl group may have 5 or 6 carbon atoms, and the biaryl group may have 9 or 10 carbon atoms. The monoaryl group may include, for example, a substituted or unsubstituted phenyl group. If the monoaryl group, for example, a phenyl group is substituted, the phenyl group may be substituted by various substituents at various locations and may be substituted by a halogen group, a hydroxyl group, a nitro group, a cyano group, a $C_1$-$C_4$ substituted or unsubstituted linear or branched alkyl group, or a $C_1$-$C_4$ linear or branched alkoxy group.

Through the whole document, the term "heteroaryl group" refers to a hetero cyclic aromatic group, and the aromatic group may include Si, O, S, Se, N, P, or As as a hetero atom. A $C_{3-30}$ heteroaryl group refers to a heteroaryl group having 3 to 30 carbon atoms, and if the $C_{3-30}$ heteroaryl group is substituted, the carbon number of a substituent is not included in the above-described carbon number. The number of the hetero atoms included in the aromatic group may be 1 or 2. The aryl group in the heteroaryl group may include a monoaryl group or a biaryl group, and may be, for example, a monoaryl group. The hetero aryl group may be substituted by various substituents at various locations and may be substituted by, for example, a halogen group, a hydroxyl group, a nitro group, a cyano group, a $C_1$-$C_4$ substituted or unsubstituted linear or branched alkyl group, or a $C_1$-$C_4$ linear or branched alkoxy group.

Through the whole document, the term "aryl alkyl group" refers to an alkyl group substituted with an aryl group. A $C_{6-30}$ aryl alkyl group refers to an alkyl group including an aryl group having 6 to 30 carbon atoms, and if the $C_{6-30}$ aryl alkyl group is substituted, the carbon number of a substituent is not included in the above-described carbon number. The aryl group in the aryl alkyl group may include a monoaryl group or a biaryl group, and the alkyl group may be a $C_{1-3}$ alkyl group, for example, a $C_1$ alkyl group. The aryl group in the aryl alkyl group may be substituted by various substituents at various locations and may be substituted by, for example, a halogen group, a hydroxyl group, a nitro group, a cyano group, a $C_1$-$C_4$ substituted or unsubstituted linear or branched alkyl group, a $C_1$-$C_4$ linear or branched alkoxy group, or a $C_1$-$C_4$ linear or branched alkyl carboxyl nitro group.

Through the whole document, the term "fused aryl group" refers to a fused polyaryl cyclic group and may include, for example, naphthalenyl group, phenanthrenyl group, anthracenyl group, benzo[a] pyrenyl group, benzo[b] pyrenyl group, benzo[e] pyrenyl group, acenaphthylenyl group, acenaphthenyl group, benzo[b] fluoranthene, benzo[j] fluoranthenyl group, crycenyl group, fluoranthenyl group, fluorenyl group, or pyrenyl group, and the fused aryl group is a substituted or unsubstituted fused aryl group. The fused aryl group may be substituted by various substituents at various locations and may be substituted by, for example, a halogen group, a hydroxyl group, a nitro group, a cyano group, a $C_1$-$C_4$ substituted or unsubstituted linear or branched alkyl group, or a $C_1$-$C_4$ linear or branched alkoxy group.

Hereinafter, embodiments of the present disclosure will be described in detail. However, the present disclosure may not be limited to the following embodiments.

In accordance with a first aspect of the present disclosure, there is provided a method for preparing metal nanoparticles, the method including reacting a hydrazine-carbon dioxide binded compound represented by the following Chemical Formula I or I' with a metal oxide represented by the following Chemical Formula II or a metal ion compound represented by the following Chemical Formula III or IV to obtain metal nanoparticles:

[Chemical Formula I]

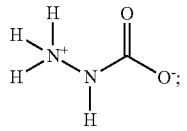

[Chemical Formula I']

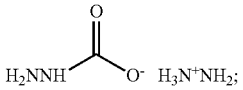

[Chemical Formula II]

$$M_aO_b;$$

[Chemical Formula III]

$$M_aX_b;$$

[Chemical Formula IV]

$$M_a(OR^1)_b;$$

in the above Chemical Formulas, $R^1$ includes a member selected from the group consisting of hydrogen; a member selected from the group consisting of a substituted or unsubstituted $C_{1-30}$ aliphatic hydrocarbon group, a substituted or unsubstituted $C_{3-30}$ aliphatic cyclic group, a substituted or unsubstituted $C_{3-30}$ heteroaliphatic cyclic group, a substituted or unsubstituted $C_{5-30}$ aromatic cyclic group, and a substituted or unsubstituted $C_{5-30}$ heteroaromatic cyclic group; a $C_{1-30}$ aliphatic hydrocarbon group including one or more selected from the group consisting of Si, O, S, Se, N, P, As, F, Cl, Br, and I; a $C_{3-30}$ aliphatic cyclic group including one or more selected from the group consisting of Si, O, S, Se, N, P, As, F, Cl, Br, and I; a $C_{3-30}$ heteroaliphatic cyclic group including one or more selected from the group consisting of Si, O, S, Se, N, P, As, F, Cl, Br, and I; and a $C_{5-30}$ heteroaromatic cyclic group including one or more selected Si, O, S, Se, N, P, As, F, Cl, Br, and I, M includes a metal element, X includes a halogen element, and a and b are positive integers.

In an embodiment of the present disclosure, the hydrazine-carbon dioxide binded compound may produce hydrogen or ammonia through a decomposition reaction (see Reaction Formulas I to III, and the produced hydrogen or ammonia serves as a reducing agent:

[Reaction Formula I]

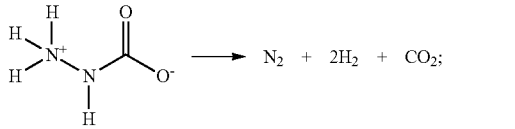

$N_2 + 2H_2 + CO_2$;

[Reaction Formula II]

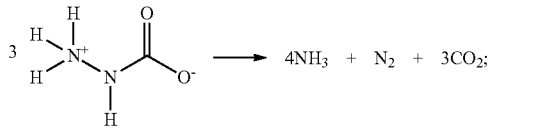

$4NH_3 + N_2 + 3CO_2$;

[Reaction Formula III]

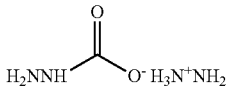

$2N_2 + 4H_2 + CO_2$.

In an embodiment of the present disclosure, the produced hydrogen reacts with oxygen from the metal oxide to be converted into water, and in the case of the metal-halide salt, the produced ammonia reacts with halogen from the metal-halide salt to form an ammonium salt and thus reduce the metal. Further, in the case of the metal-acetate salt, the produced hydrogen converts the metal-acetate salt into acetic acid and also reduces the metal while being converted into a hydrogen cation, and thus, metal nanoparticles are produced. If hydrogen is used as a reducing agent for the metal oxide or the metal ion compound, the metal oxide or the metal ion compound is reduced while converting the hydrogen into a hydrogen cation. Hydrogen is a gas at room temperature and is highly explosive, and thus, a high-pressure reactor needs to be used, but the hydrazine-carbon dioxide binded compound used in an embodiment of the present disclosure is a solid (Chemical Formula I) or in a gel (Chemical Formula I') state and thus is highly stable and very easy to be practically applied.

Since the method for preparing metal nanoparticles in accordance with an embodiment of the present disclosure may not use a solvent, the simplest process may be used. Further, since the method in accordance with an embodiment of the present disclosure does not use a solvent or uses only a minimum solvent and most of by-products are harmless gases and thus naturally removed, a purification process is almost not needed. Therefore, the method for preparing metal nanoparticles in accordance with an embodiment of the present disclosure is very eco-friendly and has high economic feasibility, and the method also overcomes the problems of the conventional production process and thus has advantages that it is the most economical and that separate production equipment is not needed In an embodiment of the present disclosure, in the reaction between the hydrazine-carbon dioxide binded compound and the metal oxide or the metal ion compound, water and carbon dioxide are produced, but the carbon dioxide is dissociated from the process of preparing the hydrazine-carbon dioxide binded compound, and thus, additional carbon dioxide is not produced in the reaction.

By way of non-limiting example, in an embodiment of the present disclosure, metal nanoparticles prepared by the preparation method may have a size of from about 1 nm to about 300 nm, but may not be limited thereto. For example, the metal nanoparticles may have a size of from about 1 nm to about 300 nm, from about 1 nm to about 250 nm, from about 1 nm to about 200 nm, from about 1 nm to about 150 nm, from about 1 nm to about 130 nm, from about 1 nm to about 100 nm, from about 1 nm to about 80 nm, from about 1 nm to about 50 nm, from about 1 nm to about 30 nm, from about 1 nm to about 10 nm, from about 10 nm to about 300 nm, from about 30 nm to about 300 nm, from about 50 nm to about 300 nm, from about 80 nm to about 300 nm, from about 100 nm to about 300 nm, from about 130 nm to about 300 nm, from about 150 nm to about 300 nm, from about 200 nm to about 300 nm, from about 250 nm to about 300 nm, from about 30 nm to about 100 nm, or from about 50 nm to about 200 nm, but may not be limited thereto.

In an embodiment of the present disclosure, the M may include copper, silver, palladium, platinum, or gold, but may not be limited thereto.

In an embodiment of the present disclosure, the $R^1$ may include a $C_{1-10}$ alkyl group, a $C_{6-20}$ aryl group, a formyl group, or a $C_{1-10}$ acyl group, but may not be limited thereto.

In an embodiment of the present disclosure, the $R^1$ may include methyl group, ethyl group, propyl group, isopropyl group, n-butyl group, isobutyl group, sec-butyl group, tert-butyl group, n-pentyl group, isopentyl group, sec-pentyl group, tert-pentyl group, hexyl group, heptyl group, octyl group, nonyl group, decyl group, phenyl group, biphenyl group, triphenyl group, benzyl group, naphthyl group, anthryl group, phenanthryl group, formyl group, acetyl group, or ethanoyl group, but may not be limited thereto.

In an embodiment of the present disclosure, the reaction between the hydrazine-carbon dioxide binded compound and the metal oxide or the metal ion compound may be carried out at a temperature of from about 10° C. to about 200° C., but may not be limited thereto. For example, the temperature may be from about 10° C. to about 200° C., from about 30° C. to about 200° C., from about 50° C. to about 200° C., from about 80° C. to about 200° C., from about 110° C. to about 200° C., from about 130° C. to about 200° C., from about 150° C. to about 200° C., from about 170° C. to about 200° C., from about 10° C. to about 170° C., from about 30° C. to about 170° C., from about 50° C. to about 170° C., from about 80° C. to about 170° C., from about 110° C. to about 170° C., from about 130° C. to about 170° C., from about 150° C. to about 170° C., from about 10° C. to about 150° C., from about 30° C. to about 150° C., from about 50° C. to about 150° C., from about 80° C. to about 150° C., from about 110° C. to about 150° C., from about 130° C. to about 150° C., from about 10° C. to about 130° C., from about 30° C. to about 130° C., from about 50° C. to about 130° C., from about 80° C. to about 130° C., from about 110° C. to about 130° C., from about 10° C. to about 110° C., from about 30° C. to about 110° C., from about 50° C. to about 110° C., from about 70° C. to about 110° C., from about 90° C. to about 110° C., from about 10° C. to about 90° C., from about 30° C. to about 90° C., from about 50° C. to about 90° C., from about 10° C. to about 30° C., or from about 10° C. to about 50° C., but may not be limited thereto.

In an embodiment of the present disclosure, the reaction between the hydrazine-carbon dioxide binded compound and the metal oxide or the metal ion compound may be carried out in a solvent-free state without using a solvent, but may not be limited thereto. For example, if all of reactants in the reaction are solids, the reaction can be carried out by grinding or contact between solid powder particles, and thus, a separation or purification process is almost not needed and almost no by-products are produced, so that eco-friendly solvent-free dry synthesis can be performed. According to the method for preparing metal nanoparticles in accordance with an embodiment of the present disclosure, a solvent-free reaction is carried out without using a solvent, and thus, a reaction rate and selectivity can be increased.

In an embodiment of the present disclosure, the reaction between the hydrazine-carbon dioxide binded compound and the metal oxide or the metal ion compound may be carried out in a slurry state in the presence of a solvent, but may not be limited thereto. If the reaction is performed in the presence of a solvent, the amount of the solvent used may be about 70 wt % or less with respect to the total weight of the metal nanoparticles, but may not be limited thereto. For example, the amount of the solvent used may be about 70 wt % or less, about 60 wt % or less, about 50 wt % or less, about 40 wt % or less, about 30 wt % or less, about 20 wt % or less, about 10 wt % or less, from about 0.1 wt % to about 70 wt %, from about 0.1 wt % to about 60 wt %, from about 0.1 wt % to about 50 wt %, from about 0.1 wt % to about 40 wt %, from about 0.1 wt % to about 30 wt %, from about 0.1 wt % to about 20 wt %, from about 0.1 wt % to about 10 wt %, from about 0.1 wt % to about 1 wt %, from about 1 wt % to about 70 wt %, from about 10 wt % to about 70 wt %, from about 20 wt % to about 70 wt %, from about 30 wt % to about 70 wt %, from about 40 wt % to about 70 wt %, from about 50 wt % to about 70 wt %, or from about 60 wt % to about 70 wt % with respect to the total weight of the metal nanoparticles, but may not be limited thereto. For example, if the solvent is used in the amount of about 70 wt % or less, a reaction rate and selectivity can be increased as compared with a conventional method in which a solvent is used in the amount of from about 80 wt % to about 95 wt %, but may not be limited thereto.

In an embodiment of the present disclosure, the solvent may include a member selected from the group consisting of an alcohol having 1 to 15 carbon atoms, an ether having 2 to 16 carbon atoms, an aliphatic hydrocarbon having 5 to 15 carbon atoms, an aromatic hydrocarbon having 6 to 15 carbon atoms, and combinations thereof, but may not be limited thereto.

In an embodiment of the present disclosure, if the alcohol having 1 to 15 carbon atoms is used as a solvent, the alcohol may include a member selected from the group consisting of methanol, ethanol, propanol, isopropanol, n-butanol, isobutanol, sec-butanol, tert-butanol, n-pentanol, isopentanol, sec-pentanol, tert-pentanol, hexanol, heptanol, octanol, nonanol, decanol, undecanol, dodecanol, pentadecanol, ethylene glycol, glycerol, erythritol, xylitol, mannitol, polyol, and combinations thereof, but may not be limited thereto.

In an embodiment of the present disclosure, if the ether having 2 to 16 carbon atoms is used as a solvent, the ether may include a member selected from the group consisting of dimethyl ether, diethyl ether, tetrahydrofuran, dioxin, and combinations thereof, but may not be limited thereto.

In an embodiment of the present disclosure, if the aliphatic hydrocarbon having 5 to 15 carbon atoms is used as a solvent, the aliphatic hydrocarbon may include a member selected from the group consisting of pentane, hexane, heptane, octane, nonane, decane, undecane, dodecane, tridecane, tetradecane, pentadecane, and combinations thereof, but may not be limited thereto.

In an embodiment of the present disclosure, if the aromatic hydrocarbon having 6 to 15 carbon atoms is used as a solvent, the aromatic hydrocarbon may include a member selected from the group consisting of benzene, toluene, phenol, benzoic acid, nitro benzene, xylene, naphthalene, and combinations thereof, but may not be limited thereto.

In accordance with a second aspect of the present disclosure, there are provided metal nanoparticles prepared by the preparing method in accordance with the first aspect of the present disclosure.

In an embodiment of the present disclosure, the metal nanoparticles may have a size of from about 1 nm to about 300 nm, but may not be limited thereto. For example, the metal nanoparticles may have a size of from about 1 nm to about 300 nm, from about 1 nm to about 250 nm, from about 1 nm to about 200 nm, from about 1 nm to about 150 nm, from about 1 nm to about 130 nm, from about 1 nm to about 100 nm, from about 1 nm to about 80 nm, from about 1 nm to about 50 nm, from about 1 nm to about 30 nm, from about 1 nm to about 10 nm, from about 10 nm to about 300 nm, from about 30 nm to about 300 nm, from about 50 nm to about 300 nm, from about 80 nm to about 300 nm, from about 100 nm to about 300 nm, from about 130 nm to about 300 nm, from about 150 nm to about 300 nm, from about 200 nm to about 300 nm, from about 250 nm to about 300 nm, from about 30 nm to about 100 nm, or from about 50 nm to about 200 nm, but may not be limited thereto.

The metal nanoparticles in accordance with the second aspect of the present disclosure are prepared by the preparing method in accordance with the first aspect of the present disclosure. Detailed descriptions of the repeated parts as described in the first aspect of the present disclosure will be omitted. Although omitted in the second aspect of the present disclosure, the description of the first aspect of the present disclosure may also be applied in the same manner to the second aspect.

MODE FOR CARRYING OUT THE INVENTION

Hereinafter, examples will be described in more detail with reference to the accompanying drawings. However, the following examples are provided only for more easily understanding of the present disclosure, but the present disclosure is not limited thereto.

EXAMPLES

Metal nanoparticles in accordance with the present examples may be synthesized without using a solvent during preparation, or may be synthesized using, as a solvent, an alcohol having 1 to 15 carbon atoms, an ether having 2 to 16 carbon atoms, an aliphatic hydrocarbon having 5 to 15 carbon atoms, an aromatic hydrocarbon having 6 to 15 carbon atoms, and combinations thereof in the amount of about 70 wt % or less with respect to the total weight of as-prepared metal oxide, metal-halide salt, metal-acetate salt, or metal-alkoxide. In a solid reaction or a slurry phase reaction using a solvent, the yield of the metal nanoparticles is 99% or more.

Example 1

7.6 g (100.0 mmol) of solid hydrazine ($H_3N^+HCO_2^-$) and 1.99 g (25.0 mmol) of copper (II) oxide (CuO) were mixed without solvent in a mortar for 10 minutes and the mixture was placed in an 80° C. oven, and after 12 hours, a product was confirmed by X-ray powder diffraction (XRD). The result of the XRD is as shown in FIG. 1.

FIG. 1 shows an XRD pattern of the copper nanoparticles prepared in accordance with the present example of the present disclosure, and the vertical bars at the bottom are theoretical XRD patterns of Cu and CuO, respectively. It was confirmed that the overall copper oxide as a precursor was converted into a copper metal without the presence of any other by-products, and the produced copper metal was observed as having an average particle diameter of about 25 nm.

Example 2

Solid hydrazine and CuO were mixed in the same conditions as those of Example 1 and the mixture was placed in a 100° C. oven, and after 1 hour, a product was confirmed by XRD. It could be seen that a copper metal was produced to have a size of about 35 nm.

Example 3

Solid hydrazine and CuO were mixed in the same conditions as those of Example 1 and the mixture was placed in a 150° C. oven, and after 0.1 hour, a product was confirmed by XRD. It could be seen that a copper metal was produced to have a size of about 42 nm.

Example 4

Sol id hydrazine and CuO were mixed in the same conditions as those of Example 1 and the mixture was placed in a 50° C. oven, and after 72 hours, a product was confirmed by XRD. It could be seen that a copper metal was produced to have a size of about 19 nm.

Example 5

A copper metal was obtained in the same manner as that of Example 1 except that 4.00 g (50.0 mmol) of CuO was used, and the produced copper metal was confirmed by XRD. It could be seen that the copper metal was produced to have a size of about 24 nm.

Example 6

A copper metal was obtained in the same manner as that of Example 1 except that 1.00 g (12.5 mmol) of CuO was used, and the produced copper metal was confirmed by XRD. It could be seen that the copper metal was produced to have a size of about 23 nm.

Example 7

A copper metal was obtained in the same manner as that of Example 1 except that 19.96 g (100.0 mmol) of copper (II) acetate-monohydrate ($Cu(OAc)_2.H_2O$) was used instead of CuO (25.0 mmol) and a time of placing the mixture in the oven was limited to 1 hour, and the produced copper metal was confirmed by XRD. It could be seen that the copper metal was produced to have a size of about 15 nm.

Example 8

A copper metal was obtained in the same manner as that of Example 3 except that 8.52 g (50.0 mmol) of copper (II) chloride-dihydrate ($CuCl_2.2H_2O$) was used instead of CuO (25.0 mmol) and a time of placing the mixture in the oven was limited to 3 hours, and the produced copper metal was confirmed by XRD. It was observed that the copper metal was produced to have a size of about 30 nm, and it could be seen that ammonium chloride was also present.

Example 9

The same reaction as that of Example 1 was carried out except that 7.17 g (50.0 mmol) of silver chloride (AgCl) was used instead of CuO (25.0 mmol) and a time of placing the mixture in the oven was limited to 3 hours, and the produced metal particles were confirmed by XRD. The result of the XRD is as shown in FIG. 2.

Figure 2:
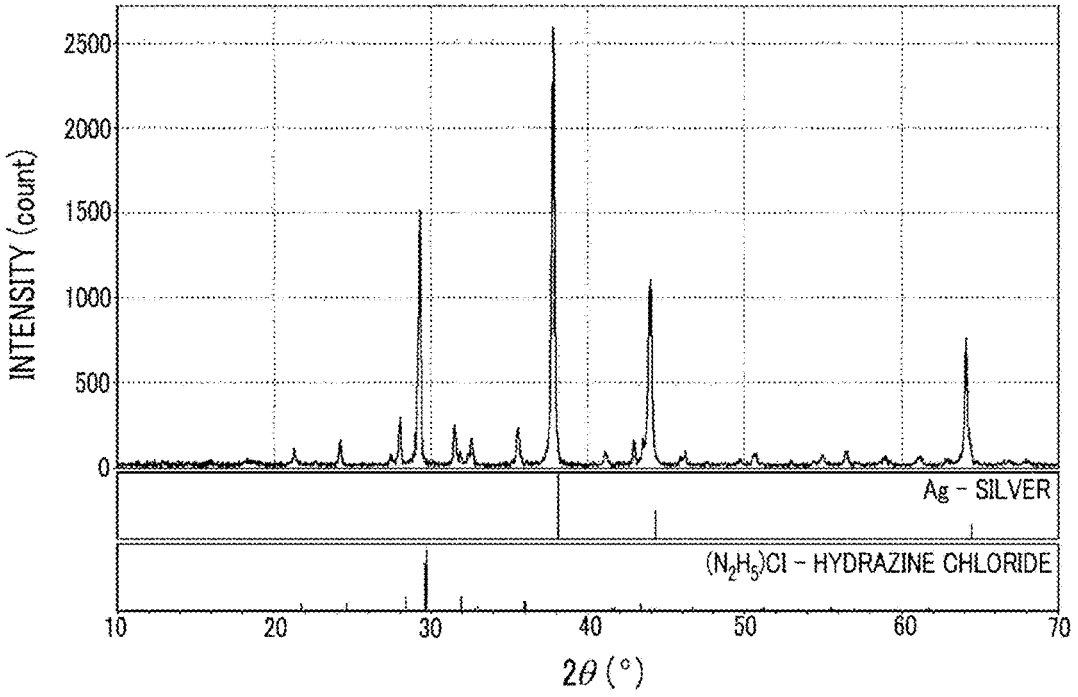
FIG. 2 shows an XRD pattern of silver nanoparticles prepared in accordance with an example of the present disclosure: the vertical bars at the bottom are theoretical XRD patterns of Ag and $(N_2H_5)Cl$, respectively.

FIG. 2 shows an XRD pattern of silver nanoparticles prepared in accordance with the present example of the present disclosure, and the vertical bars at the bottom are theoretical XRD patterns of Ag and $(N_2H_5)Cl$, respectively. It was confirmed that after the reaction, the overall silver chloride as a precursor was converted into a silver metal, and the silver particles were observed as having an average particle diameter of about 10 nm, and it could be seen that ammonium chloride was also present.

Example 10

A silver metal was obtained in the same manner as that of Example 1 except that 8.35 g (50.0 mmol) of silver acetate (AgOAc) was used instead of CuO (25.0 mmol), a time of placing the mixture in the oven was limited to 0.1 hour and a temperature in the oven was limited to 25° C., and the produced silver metal was confirmed by XRD. It was observed that the silver metal was observed as having an average particle diameter of about 8 nm, and it could be seen that acetic acid was also present.

Example 11

The same reaction as that of Example 1 was carried out except that 8.87 g (50.0 mmol) of palladium (II) chloride ($PdCl_2$) was used instead of CuO (25.0 mmol) and a time of placing the mixture in the oven was limited to 1 hour, and the produced metal particles were confirmed by XRD. The result of the XRD is as shown in FIG. 3.

Figure 3:
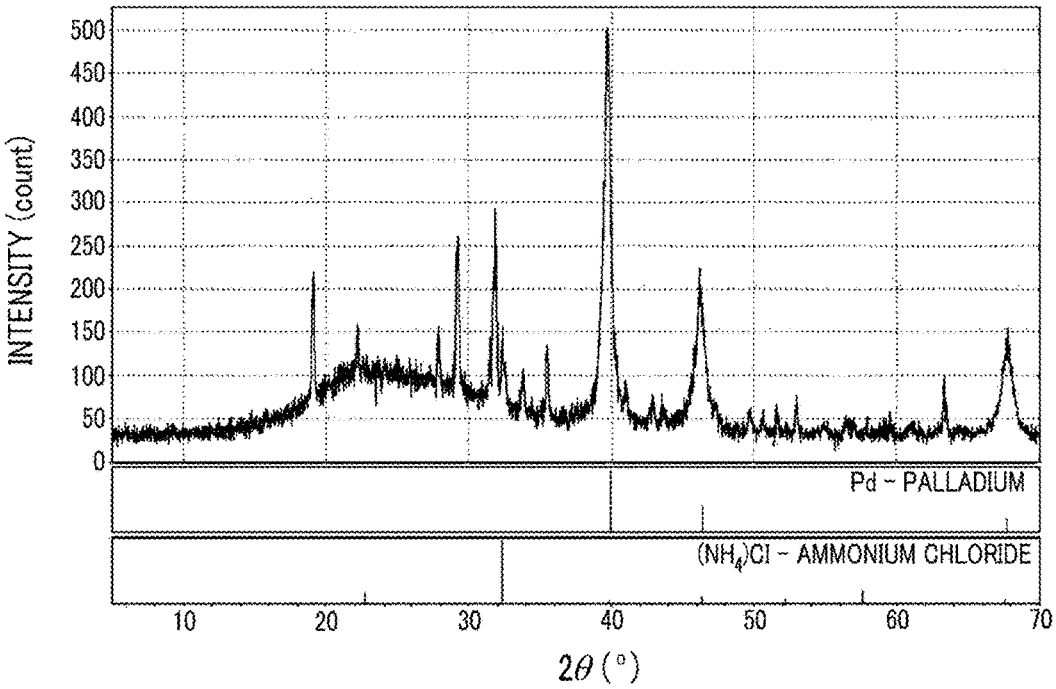
FIG. 3 shows an XRD pattern of palladium nanoparticles prepared in accordance with an example of the present disclosure: the vertical bars at the bottom are theoretical XRD patterns of Pd and $(NH_4)Cl$, respectively.

FIG. 3 shows an XRD pattern of palladium nanoparticles prepared in accordance with the present example of the present disclosure, and the vertical bars at the bottom are theoretical XRD patterns of Pd and $(NH_4)Cl$, respectively. It was confirmed that overall $PdCl_2$ as a precursor was converted into a palladium metal, and the produced palladium metal was observed as having an average particle diameter of about 5 nm, and it could be seen that ammonium chloride was also present.

Example 12

The same reaction as that of Example 1 was carried out except that 11.2 g (50.0 mmol) of palladium (II) acetate [$Pd(OAc)_2$] was used instead of CuO (25.0 mmol) and a time of placing the mixture in the oven was limited to 1 hour, and the produced metal particles were confirmed by XRD. The produced palladium metal was observed as having an average particle diameter of about 5 nm, and it could be seen that acetic acid was also present.

Example 13

The same reaction as that of Example 1 was carried out except that 6.12 g (50.0 mmol) of palladium (II) oxide (PdO) was used instead of CuO (25.0 mmol) and a time of placing the mixture in the oven was limited to 1 hour, and the produced metal particles were confirmed by XRD. The produced palladium metal was observed as having an average particle diameter of about 5 nm.

Example 14

The same reaction as that of Example 1 was carried out except that 1.33 g (5.0 mmol) of platinum (II) chloride ($PtCl_2$) and 0.76 g (10.0 mmol) of solid hydrazine ($H_3N^+NHCO_2^-$) were used and a time of placing the mixture in the oven was limited to 1 hour, and the produced metal particles were confirmed by XRD. The result of the XRD is as shown in FIG. 4.

Figure 4:
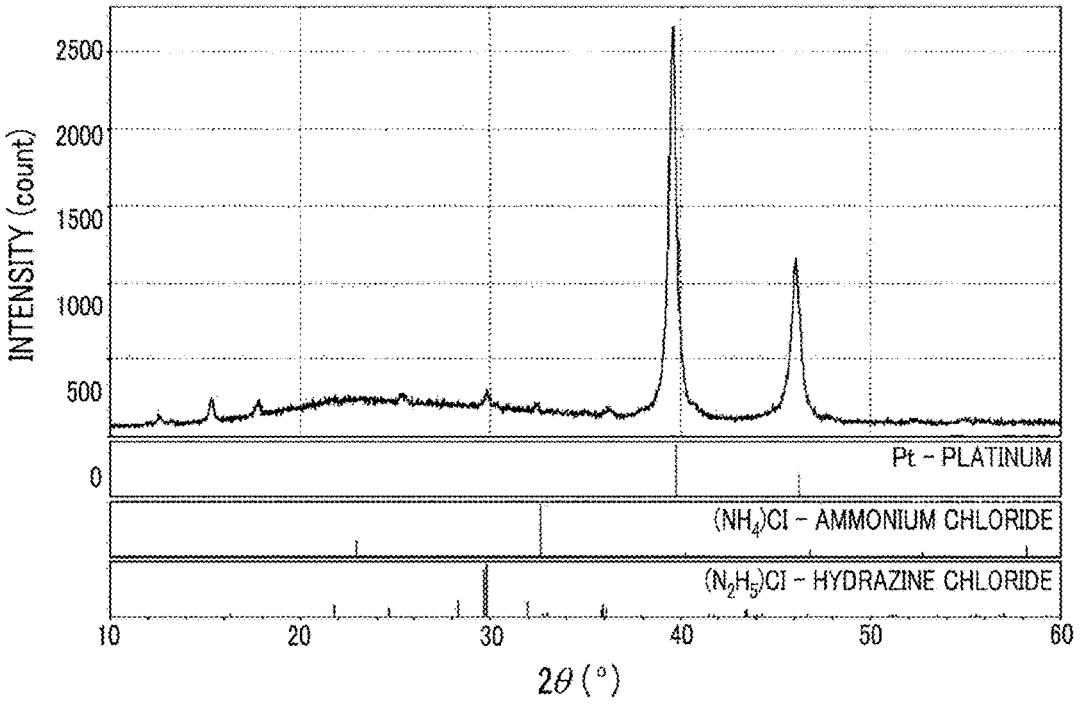
FIG. 4 shows an XRD pattern of platinum nanoparticles prepared in accordance with an example of the present disclosure: the vertical bars at the bottom are theoretical XRD patterns of Pt, $(NH_4)Cl$, and $(N_2H_5)Cl$, respectively.

FIG. 4 shows an XRD pattern of platinum nanoparticles prepared in accordance with the present example of the present disclosure, and the vertical bars at the bottom are theoretical XRD patterns of Pt, $(NH_4)Cl$, and $(N_2H_5)Cl$, respectively. According to the analysis, it was confirmed that overall $PtCl_2$ as a precursor was converted into a platinum metal, and the produced platinum was observed as having an average particle diameter of about 8 nm, and it could be seen that ammonium chloride was also present.

Example 15

The same reaction as that of Example 1 was carried out except that 0.67 g (2.5 mmol) of $PtCl_2$ and 0.76 g (10.0 mmol) of solid hydrazine ($H_3N^+NHCO_2^-$) were used and a time of placing the mixture in the oven was limited to 1 hour, and the produced metal particles were confirmed by XRD. The platinum metal was observed as having an average particle diameter of about 6 nm, and it could be seen that ammonium chloride was also present.

Example 16

The same reaction as that of Example 1 was carried out except that 0.34 g (1.25 mmol) of $PtCl_2$ and 0.76 g (10.0 mmol) of solid hydrazine ($H_3N^+NHCO_2^-$) were used and a time of placing the mixture in the oven was limited to 1 hour, and the produced metal particles were confirmed by XRD. The platinum metal was observed as having an average particle diameter of about 4 nm, and it could be seen that ammonium chloride was also present.

Example 17

The same reaction as that of Example 1 was carried out except that 1.135 g (5.0 mmol) of platinum (IV) oxide ($PtO_2$, Adam's catalyst) and 0.76 g (10.0 mmol) of solid hydrazine ($H_3N^+NHCO_2^-$) were used and a time of placing the mixture in the oven was limited to 0.5 hours, and the produced metal particles were confirmed by XRD. The platinum metal was observed as having an average particle diameter of about 5 nm.

Example 18

The same reaction as that of Example 1 was carried out except that 1.52 g (5.0 mmol) of gold (III) chloride ($AuCl_3$) and 0.76 g (10.0 mmol) of solid hydrazine ($H_3N^+NHCO_2^-$) were used and a time of placing the mixture in the oven was limited to 0.1 hour, and the produced metal particles were confirmed by XRD. The result of the XRD is as shown in FIG. 5.

Figure 5:
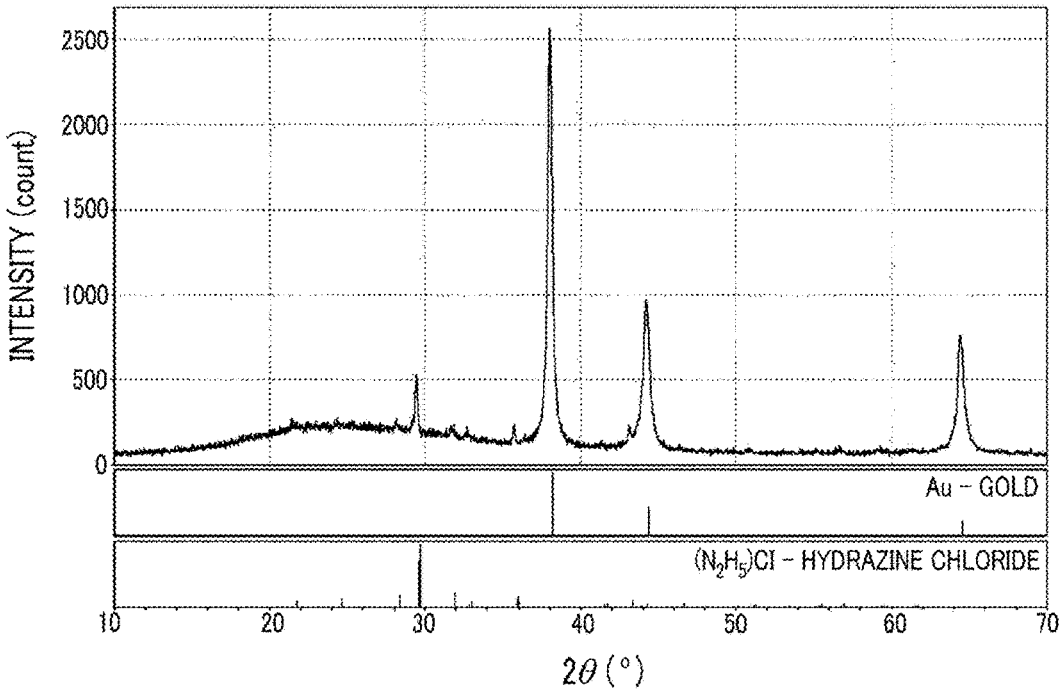
FIG. 5 shows an XRD pattern of gold nanoparticles prepared in accordance with an example of the present disclosure: the vertical bars at the bottom are theoretical XRD patterns of Au and $(N_2H_5)Cl$, respectively.

FIG. 5 shows an XRD pattern of gold nanoparticles prepared in accordance with the present example of the present disclosure, and the vertical bars at the bottom are theoretical XRD patterns of Au and $(N_2H_5)Cl$, respectively. The gold metal was observed as having an average particle diameter of about 5 nm, and it could be seen that hydrazine chloride was also present.

Example 19

The same reaction as that of Example 1 was carried out except that 1.28 g (5.0 mmol) of gold (I) acetate (AuOAc) and 0.76 g (10.0 mmol) of solid hydrazine ($H_3N^+NHCO_2^-$) were used and a time of placing the mixture in the oven was limited to 0.1 hour, and the produced metal particles were confirmed by XRD. The gold metal was observed as having an average particle diameter of about 5 nm, and it could be seen that acetic acid was also present.

The above description of the present disclosure is provided for the purpose of illustration, and it would be understood by those skilled in the art that various changes and modifications may be made without changing technical conception and essential features of the present disclosure. Thus, it is clear that the above-described examples are illustrative in all aspects and do not limit the present disclosure. For example, each component described to be of a single type can be implemented in a distributed manner. Likewise, components described to be distributed can be implemented in a combined manner.

The scope of the present disclosure is defined by the following claims rather than by the detailed description of the embodiment. It shall be understood that all modifications and embodiments conceived from the meaning and scope of the claims and their equivalents are included in the scope of the present disclosure.

We claim:

1. A method for preparing metal nanoparticles, comprising: reacting a solid or gel hydrazine-carbon dioxide binded compound represented by the following Chemical Formula I or I', respectively, with a metal oxide represented by the following Chemical Formula II or a metal ion compound represented by the following Chemical Formula III or IV to obtain metal nanoparticles, wherein the reaction is carried out in a solvent-free state without using a solvent:

<Chemical Formula I>

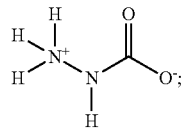

<Chemical Formula I'>

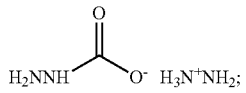

<Chemical Formula II>

$M_aO_b$;

<Chemical Formula III>

$M_aX_b$;

<Chemical Formula IV>

$M_a(OR^1)_b$;

wherein in the above Chemical Formulas, $R^1$ includes a member selected from the group consisting of hydrogen, a substituted or unsubstituted $C_{1-30}$ aliphatic hydrocarbon group, a substituted or unsubstituted $C_{3-30}$ aliphatic cyclic group, a substituted or unsubstituted $C_{3-30}$ heteroaliphatic cyclic group, a substituted or unsubstituted $C_{5-30}$ aromatic cyclic group, a substituted or unsubstituted $C_{5-30}$ heteroaromatic cyclic group, a $C_{1-30}$ aliphatic hydrocarbon group including one or more selected from the group consisting of Si, O, S, Se, N, P, As, F, Cl, Br, and I, a $C_{3-30}$ aliphatic cyclic group including one or more selected from the group consisting of Si, O, S, Se, N, P, As, F, Cl, Br, and I, a $C_{3-30}$ heteroaliphatic cyclic group including one or more selected from the group consisting of Si, O, S, Se, N, P, As, F, Cl, Br, and I, and a $C_{5-30}$ heteroaromatic cyclic group including one or more selected Si, O, S, Se, N, P, As, F, Cl, Br, and I, M includes a metal element, X includes a halogen element, and a and b are positive integers.

2. The method for preparing nanoparticles of claim 1, wherein M is selected from the group consisting of copper, silver, palladium, platinum, and gold.

3. The method for preparing metal nanoparticles of claim 1, comprising reacting the Chemical Formula IV, wherein the $R^1$ is selected from the group consisting of a $C_{1-10}$ alkyl group, a $C_{6-20}$ aryl group, a formyl group, and a $C_{1-10}$ acyl group.

4. The method for preparing metal nanoparticles of claim 1, comprising reacting the Chemical Formula IV, wherein the $R^1$ is selected from the group consisting of methyl group, ethyl group, propyl group, isopropyl group, nbutyl group, isobutyl group, sec-butyl group, tert-butyl group, n-pentyl group, isopentyl group, sec-pentyl group, tert-pentyl group, hexyl group, heptyl group, octyl group, nonyl group, decyl group, phenyl group, biphenyl group, triphenyl group, benzyl group, naphthyl group, anthryl group, phenanthryl group, formyl group, acetyl group, and ethanoyl group.

5. The method for preparing metal nanoparticles of claim 1, wherein the reaction is carried out at a temperature of from 10° C. to 200° C.

* * * * *